US008021210B2

(12) United States Patent
Masumura et al.

(10) Patent No.: US 8,021,210 B2
(45) Date of Patent: Sep. 20, 2011

(54) POLISHING HEAD AND POLISHING APPARATUS HAVING THE SAME

(75) Inventors: Hisashi Masumura, Nishishirakawa (JP); Kouji Morita, Nishishirakawa (JP); Hiromasa Hashimoto, Nishishirakawa (JP); Satoru Arakawa, Nagano (JP); Hiromi Kishida, Nagano (JP)

(73) Assignees: Shin-Etsu Handotai Co., Ltd., Tokyo (JP); Fujikoshi Machinery Corp., Nagano (JP)

( * ) Notice: Subject to any disclaimer, the term of this patent is extended or adjusted under 35 U.S.C. 154(b) by 0 days.

(21) Appl. No.: 12/733,535

(22) PCT Filed: Oct. 20, 2008

(86) PCT No.: PCT/JP2008/002962
§ 371 (c)(1),
(2), (4) Date: Mar. 26, 2010

(87) PCT Pub. No.: WO2009/057258
PCT Pub. Date: May 7, 2009

(65) Prior Publication Data

US 2010/0291838 A1 Nov. 18, 2010

(30) Foreign Application Priority Data

Oct. 31, 2007 (JP) ..... 2007-283864

(51) Int. Cl.
*B24B 49/00* (2006.01)

(52) U.S. Cl. ..... 451/8; 451/285; 451/289; 451/397

(58) Field of Classification Search ..... 451/5, 8, 451/41, 285–290, 384, 385, 390, 402
See application file for complete search history.

(56) References Cited

U.S. PATENT DOCUMENTS 6,056,632 A * 5/2000 Mitchel et al. ..... 451/288
6,443,820 B2 * 9/2002 Kimura ..... 451/285
6,645,044 B2 * 11/2003 Zuniga ..... 451/5
(Continued)

FOREIGN PATENT DOCUMENTS

JP A-11-163101 6/1999
(Continued)

OTHER PUBLICATIONS

International Search Report issued in International Application No. PCT/JP2008/002962 on Dec. 9, 2008 (with English-language translation).

*Primary Examiner* — Maurina Rachuba
(74) *Attorney, Agent, or Firm* — Oliff & Berridge, PLC

(57) ABSTRACT

The present invention is a polishing head in which a rubber film is formed in a boot shape in such a manner that a position where the rubber film is held by a mid plate is distantly positioned from a work holding portion; an end portion of the boot shaped rubber film is formed in O-ring shape so that the rubber film is held by the mid plate with decreasing an area of contact between the mid plate and the rubber film as much as possible. As a result, there is provided a polishing head with rubber chuck method in which an occurrence of a surface defect, such as a scratch, on a surface of the work is suppressed as much as possible and the work can be uniformly and stably polished to the outer periphery.

20 Claims, 8 Drawing Sheets

U.S. PATENT DOCUMENTS

| | | | | |
|---|---|---|---|---|
| 6,890,402 | B2 * | 5/2005 | Gunji et al. | 156/345.14 |
| 6,966,822 | B2 * | 11/2005 | Kajiwara et al. | 451/41 |
| 6,976,908 | B2 * | 12/2005 | Masunaga et al. | 451/288 |
| 7,001,245 | B2 * | 2/2006 | Chen | 451/8 |
| 7,727,055 | B2 * | 6/2010 | Zuniga et al. | 451/398 |
| 7,897,007 | B2 * | 3/2011 | Gunji et al. | 156/345.12 |
| 2009/0064452 | A1 * | 3/2009 | Thatcher et al. | 15/364 |

FOREIGN PATENT DOCUMENTS

| | | |
|---|---|---|
| JP | A-2000-127024 | 5/2000 |
| JP | A-2001-310257 | 11/2001 |
| JP | A-2002-231663 | 8/2002 |
| JP | A-2002-264005 | 9/2002 |
| JP | A-2003-039306 | 2/2003 |
| JP | A-2007-021614 | 2/2007 |

* cited by examiner

POLISHING HEAD AND POLISHING APPARATUS HAVING THE SAME

TECHNICAL FIELD

The present invention relates to a polishing head for holding a work when a surface of the work is polished and a polishing apparatus having it, and more particularly to a polishing head for holding the work on a rubber film and a polishing apparatus having it.

BACKGROUND ART

In recent years, due to a high integration of semiconductor device, a demand for flatness of a semiconductor silicon wafer used for it becomes more and more strict. The flatness is needed to an area near the edge of the wafer to improve a yield of semiconductor chip.

The final shape of a silicon wafer depends on a mirror polishing process that is the last step. In particular, the silicon wafer having a diameter of 300 mm is subjected to first polishing by a double-side polishing in order to satisfy a strict specification of the flatness and then second polishing of a single-side surface and final polishing are performed in order to improve a scratch on the surface and surface roughness. The second polishing of a single-side surface and the final polishing are required to maintain the flatness made by the first polishing of double-side surfaces and to make the wafer surface a perfect mirror surface in which there exist no defects such as a scratch on the surface.

As shown in FIG. 8, a common single-side polishing apparatus comprises a turn table 83 onto which a polishing pad 82 is attached, a polishing agent supply mechanism 84, a polishing head 85 and the like. The polishing apparatus 81 polishes a work W by holding the work W with the polishing head 85, supplying the polishing agent 86 to the polishing pad 82 from the polishing agent supply mechanism 84, rotating the turn table 83 and the polishing head 85, respectively, and bringing the surface of the work W into sliding contact with the polishing pad 82.

As a method for holding the work on the polishing head, for example, there is a method of attaching the work onto a flat disk-shaped plate through an adhesive such as a wax and the like. Other than that, as shown in FIG. 9, there is a method in which a elastic film that is referred as a backing film 93 is attached to a work holding plate 92 to hold the work for the purpose of suppressing a transfer of the concavo-convex shape of polishing head body 91 and the work holding plate 92. In addition, there is a so-called rubber chuck method in which a work holding portion is made of a rubber film, a pressurized fluid such as air is poured into a back face of the rubber film, and the rubber film is inflated by a uniform pressure so as to press the work to the polishing pad (See Japanese Patent Application Laid-open (kokai) No. 2002-264005). A polishing head provided with a retainer ring outside the work, the retainer ring which is a means for pressing the polishing pad, is also proposed for the purpose of suppressing sag in an outer peripheral portion of the work to improve the flatness.

An example of structure of the conventional polishing head of a rubber chuck method is schematically shown in FIG. 10(*a*). The structure is as follows. A rubber film (rubber material) 104*a* is attached in such a manner that a concave portion of a mid plate 102*a* provided with the concave portion at its lower face is sealed. A fluid is supplied to a first sealed space portion 103*a* through a first pressure adjustment mechanism 105*a* so that a wafer W can be pressed, so-called a rubber chuck structure. Moreover, the mid plate 102*a* is connected with a polishing head body 101*a* through an elastic film 106*a*. A fluid is supplied to a second sealed space portion 107*a*, which is sealed with the elastic film 106*a*, through a second pressure adjustment mechanism 108*a* so that the mid plate 102*a* can be pressured. An annular guide ring 109*a* is connected with the polishing head body 101*a* to hold the wafer during polishing process so that the guide ring is arranged outside the wafer W. Moreover, there is a method of pressuring only by the rubber film 104*b* without a pressuring mechanism of the mid plate 102*b* as shown in FIG. 10(*b*). Furthermore, as shown in FIG. 10(*c*) a polishing head provided with a retainer ring, which presses the polishing pad instead of the guide ring, is also proposed for the purpose of suppressing sag in the outer peripheral portion of the work. The retainer ring 109*c* presses the polishing pad with being supplied a fluid to a third sealed space portion 111*c*, which is sealed with the elastic film 110*c*, through a third pressure adjustment mechanism 112*c*.

In the case of a structure in which the rubber film is provided in tension at an opening end portion of the concave portion of a mid plate as shown in FIG. 10(*a*), (*b*), there is a problem that stiffness of the rubber film near the opening end portion substantially becomes high under the influence of the tension, pressure applied on the outer peripheral portion of the work becomes high, and thereby an outer peripheral sag occurs. Moreover, a method in which a position of a holding portion P (the opening end portion) of the rubber film is raised against the work to decrease pressure of the outer peripheral portion so that the outer peripheral sag is suppressed as shown in FIG. 10(*d*) is proposed (See Japanese Patent Application Laid-open (kokai) No. 2002-264005, for example). However, there occurs a problem that trying to improve the outer peripheral sag of the wafer results in forming a shape raised on the outer periphery of the wafer, uniformity deteriorates, the shape does not stabilize under the influence of variability of the tension when the rubber film is provided in tension, and the like. The method in which a retainer ring is provided outside the work to directly press the polishing pad so that the outer peripheral sag is suppressed as shown in FIG. 10(*c*) is also proposed. However, since a retainer material is also polished, there occurs a problem that a scratch is generated on a surface of the work under the influence of generation of dust and the like from that, a polishing agent is not sufficiently supplied to the work surface because it presses the polishing pad, and thus a decrease in polishing rate is caused and the like.

DISCLOSURE OF INVENTION

In view of the above-explained problems, it is an object of the present invention to provide a polishing head by rubber chuck method and a polishing apparatus having the polishing head in which an occurrence of a surface defect, such as a scratch, on a surface of the work is suppressed as much as possible and the work can be uniformly and stably polished to the outer periphery.

In order to accomplish the above object, the present invention provides a polishing head having at least: an approximately discoid mid plate; a rubber film held by the mid plate, the rubber film covering at least a lower face portion and a side face portion of the mid plate; and an annular guide ring provided in a periphery of the rubber film at a lower portion of a polishing head body, the polishing head in which there exists a first sealed space portion surrounded by the mid plate and the rubber film, a pressure of the first sealed space portion can be changed by a first pressure adjustment mechanism, a back face of a work is held on a lower face portion of the rubber film, and a surface of the work is brought into sliding contact with a polishing pad attached onto a turn table for performing polishing, wherein an end portion of the rubber film held by the mid plate is formed in O-ring shape, the mid plate is formed to be capable of vertically splitting in two pieces, the mid plate and the rubber film have a space at least throughout a whole surface of the lower face portion and the side face portion of the mid plate, and the rubber film is held by pinching the O-ring end portion of the rubber film between the split mid plate.

In this manner, the rubber film is formed in a boot shape, which is a hollow disk-shape where the upper portion is opened circularly, in such a manner that a position where the rubber film is held by the mid plate is distantly positioned from a work holding portion side. Moreover, an end portion of the boot shaped rubber film is formed in O-ring shape so that the rubber film is held by the mid plate with decreasing an area of contact between the mid plate and the rubber film as much as possible. The structure enables suppressing an extra tension generated in the rubber film, and subjecting to polishing with applying a uniform polishing load over the work without increasing stiffness of the rubber film near the outer peripheral portion of the work.

As a result, the work can be polished with keeping a high flatness over the whole surface of the work in particular in the outer peripheral portion in comparison with the conventional polishing head. That is, the polishing head becomes one in which the work can be uniformly polished to the outer peripheral portion.

In addition, the influence of generation of dust and the like is suppressed since the retainer ring and the like is not used. Therefore, the polishing head becomes one in which an occurrence of a scratch or a defect on the surface of the work can be prevented.

Furthermore, the polishing head becomes one in which the outer peripheral sag can be suppressed even if the retainer ring and the like, which presses the polishing pad, is not provided.

Moreover, it is preferable that the mid plate is separated from the polishing head body, the polishing head comprises a first height adjustment mechanism for adjusting a position in a height direction of the mid plate with being independent from the polishing head body.

In this manner, when the mid plate is separated from the polishing head body to be capable of adjusting the height of the mid plate, a height of the rubber film fixed to the mid plate can be adjusted. Due to this, pressure to the outer peripheral portion of the work can be changed by using stiffness of a side face of the rubber film. Further, when the first height adjustment mechanism that precisely controls the position in a height direction of the mid plate is provided, it become easier that a processing condition is changed according to the work shape before polishing (rise or sag shape) to perform uniformly polishing the work after processing.

Moreover, it is preferable that the polishing head body is separated from the mid plate, the polishing head comprises a second height adjustment mechanism for adjusting a position in a height direction of the polishing head body with being independent from the mid plate, the second height adjustment mechanism maintains a distance of a space between, the polishing pad and the guide ring within a range of 25-45% of a thickness of the work.

In this manner, when the polishing head comprises a height adjustment mechanism (the second height adjustment mechanism) for the polishing head body, namely guide ring, the space between the polishing pad and the guide ring can be kept constant and thereby the work can be more stably held to perform the polishing of the work without a decrease in polishing rate and a deterioration of quality of the work surface.

Furthermore, when the distance of the space between the polishing pad and the guide ring is maintained within a range of 25-45% of a thickness of the work, a decrease in polishing rate caused by a shortage of supplying the polishing agent occurred when the space between the polishing pad and the guide ring is too small can be prevented, and it can be prevented that the work cannot be held during the polishing when the space is too big.

Moreover, it is preferable that the first height adjustment mechanism and the second height adjustment mechanism use a ball screw.

In this manner, the first and the second height adjustment mechanism use a ball screw, it becomes easier to precisely adjust the position in a height direction, and thereby more high precision and stable polishing can be performed.

Moreover, it is preferable that the polishing head comprises an elastic film for connecting the mid plate with the polishing head body and a stopper attached to the polishing head body, and that there exists a second sealed space portion surrounded by the mid plate, the polishing head body and the elastic film, a pressure of the second sealed space portion can be changed by a second pressure adjustment mechanism, and the first height adjustment mechanism is the stopper.

In this manner, when the mid plate and the polishing head body are connected through the elastic film, and the pressure of the second sealed space portion sealed with the mid plate, the polishing head body and the elastic film is adjusted, the mid plate can be raised and lowered. In addition, when a height of the stopper attached to the polishing head body is adjusted, the position in a height direction of the mid plate can be adjusted, and thereby a height of the rubber film can be controlled by a simple mechanism.

Moreover, it is preferable that the stopper is a piezoelectric device.

In this manner, when further the stopper is a piezoelectric device and a thickness of the stopper can be changed by controlling applied voltage, a height of the rubber film can be optionally and automatically adjusted so that the shape of the outer peripheral portion can be optionally and automatically adjusted from sag to rise, and thereby the work can be more flatly polished.

Moreover, the present invention provides a polishing apparatus used for polishing a surface of a work at least comprising a polishing pad attached onto a turn table, a polishing agent supply mechanism for providing a polishing agent to the polishing pad and a polishing head for holding the work, which is the polishing head according to the present invention.

In this manner, when the work is polished using the polishing apparatus comprising the polishing head according to the present invention, the work can be polished with applying a uniform polishing load over the work to maintain a high flatness over the whole surface of the work in particular in the outer peripheral portion.

Moreover, it is preferable that the polishing apparatus comprises a sensor for detecting a distance between the polishing head body and the polishing pad without contact, the first height adjustment mechanism and the second height adjustment mechanism, and that the first height adjustment mechanism adjusts a position in a height direction of the mid plate and the rubber film according to the distance between the polishing head body and the polishing pad detected by the sensor and the second height adjustment mechanism adjusts a position in a height direction of the space between the polishing pad and the guide ring according to the distance between the polishing head body and the polishing pad detected by the sensor.

In this manner, when the first height adjustment mechanism that adjusts the position in a height direction of the mid plate and the rubber film according to the distance between the polishing head body and the polishing pad measured by the sensor is comprised, the polishing can be performed to modify the shape according to the shape of the work before polishing. As a result, the flatness of the surface of the work polished can be good. Furthermore, when the second height adjustment mechanism that adjusts a height of the polishing head body according to the distance between the polishing head body and the polishing pad measured by the sensor, the space between the polishing pad and the guide ring can be kept constant and thereby the work can be more stably held to perform the polishing of the work without a decrease in polishing rate and a deterioration of quality of the work surface.

As explained above, when the polishing of the work is performed using the polishing head according to the present invention, the work can be polished with applying a uniform polishing load over the work to maintain a high flatness over the whole surface of the work in particular in the outer peripheral portion.

BEST MODES FOR CARRYING OUT THE INVENTION

Figure 1:
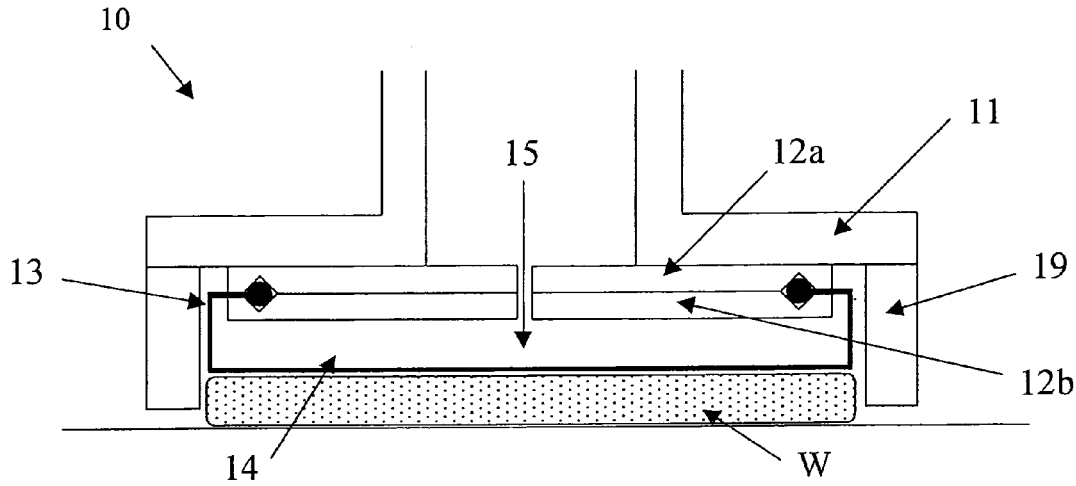
FIG. 1 is a schematic sectional view showing a first embodiment of the polishing head according to the present invention.

Hereinafter, the present invention will be explained more specifically.

As described above, particularly in the case of a work of a semiconductor silicon wafer, a high level of surface flatness and of a surface completeness without a scratch, a defect or the like are required. In the case of the polishing head by rubber chuck method, more high flatness polishing can be performed in comparison with the conventional polishing head in which the work is polished with attaching onto a ceramic plate and the like. However, there is a problem that the outer peripheral sag and the like occurs, in particular on the outer peripheral portion of the work. Moreover, for the purpose of improving the outer peripheral sag described above, the polishing head in which the retainer ring is arranged outside the work holding face to press the polishing pad near the outer peripheral portion of the work during the polishing process of the work so that the outer peripheral sag is suppressed is proposed. However, there occurs a problem that a scratch is generated on the work surface under the influence of a foreign matter and the like from the retainer ring and that a polishing agent is not sufficiently supplied to the work surface since the retainer ring presses the polishing pad, and thus a decrease in polishing rate is caused and the like. The present inventors have conducted experiments and examination in order to solve the problems and to provide a polishing head and a polishing apparatus in which the work can be highly flatly polished.

As a result, the present inventors found that the problem of a prior art is as follows.

In the conventional polishing head of a rubber chuck method, as shown in FIG. 10(*a*), the concave portion is provided to the mid plate 102*a* and the rubber film 104*a* is provided in tension at the opening end portion of the concave portion. Therefore, the structure is that the rubber film holding end portion is near the work holding portion, and stiffness of the rubber film substantially becomes high under the influence of the tension near the rubber film holding end portion, pressure applied to the outer peripheral portion of the work W becomes high, and thereby the outer peripheral sag occurs. The method in which the position of the holding portion P (the opening end portion) of the rubber film is raised against the work W to decrease pressure of the outer peripheral portion so that the outer peripheral sag is suppressed as shown in FIG. 10(*d*) is proposed. However, the present inventors found that the shape in a circuit direction does not stabilize under the influence of variability of the tension in the rubber film holding end portion.

Thus, the present inventors have keenly conducted experiments and examination. As a result, the present inventors discovered that the rubber film is formed in a boot shape, which is a hollow disk-shape where the upper portion is opened circularly, in such a manner that a position where the rubber film is held by the mid plate is distantly positioned from the work holding portion, the rubber film is held by the mid plate with decreasing an area of contact between the mid plate and the rubber film as much as possible by forming the end portion of the boot shaped rubber film (hereinafter referred to as rubber film) into O-ring shape in order to suppress an extra tension generated in the rubber film so that a uniform polishing load can be applied over the work without increasing stiffness of the rubber film near the outer peripheral portion of the work, thereby bringing the present invention to completion.

Hereinafter, a polishing head and a polishing apparatus according to the present invention will be explained specifically referring to the attached figures. However, the present invention is not limited thereto.

FIG. 1 shows a first embodiment of the polishing head according to the present invention. The polishing head 10 comprises a boot shaped rubber film 13 (rubber film) having an end portion that is formed in O-ring shape. The O-ring portion of the end portion of the rubber film 13 is held by pinching between the approximately discoid mid plate 12*a* and 12*b* having an annular groove provided for holding the O-ring portion. The rubber film 13 touches the mid plate only at the portion where the O-ring of the end portion and the like is pinched, and is held by pinching between the approximately discoid mid plate 12*a* and 12*b* in state where a bottom face and a side face of the rubber film 13 do not touch the mid plate 12*b*. Moreover, the approximately discoid mid plate 12*a* and 12*b* holding the rubber film 13 by pinching is fixed to the polishing head body 11 having a flange structure. The annular guide ring 19 for holding an edge of the work W during polishing process is arranged along the outer periphery of the work W. The guide ring 19 is connected with the polishing head body. A fluid is supplied to a first sealed space portion 14 sealed with the rubber film 13 through the first pressure adjustment mechanism 15 and thereby the rubber film 13 is inflated to apply a load to the back face of the work W.

Moreover, it is desirable that the polishing head is used with attaching backing film to the work holding portion of the rubber film 13 for the purpose of protecting the back face of the work W.

In this manner, the structure in which the fixed end portion of the rubber film 13 is arranged at a position distantly positioned from the holding portion of the work W and decreasing an area of contact between the mid plate 12*a*, 12*b* and the rubber film 13 as much as possible enable suppressing generation of an extra tension based on holding the rubber film 13 by the mid plate 12*a* and 12*b*, and thereby the work can be polished with applying a uniform polishing load over the work W.

As a result, the polishing head becomes one in which a high flatness can be kept over the whole surface of the work in comparison with the conventional polishing head and the work in which an occurrence of rise or sag is suppressed even on the outer periphery can be obtained.

Furthermore, generation of dust from the retainer material and the like is prevented since the retainer ring and the like is not used. Therefore, an occurrence of a scratch on the work surface can be suppressed. Moreover, the polishing head becomes one in which a decrease in polishing rate is not caused since the polishing agent is sufficiently supplied to the work surface.

Figure 2:
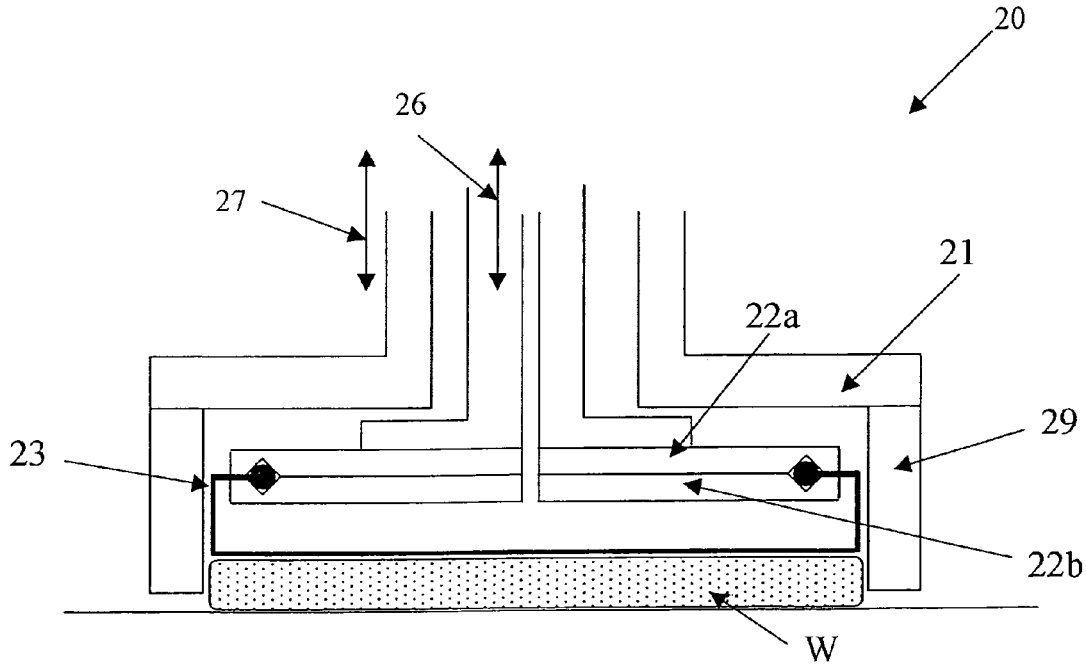
FIG. 2 is a schematic sectional view showing a second embodiment of the polishing head according to the present invention.

FIG. 2 shows a second embodiment of the polishing head according to the present invention. The polishing head 20, which is different from the polishing head 10 as shown in FIG. 1, is comprised so that the mid plate 22*a* and 22*b* are not connected with the polishing head body 21 but are connected with the first height adjustment mechanism 26, and thereby a position of the rubber film 23 can be vertically changed.

Moreover, the polishing head 20 is comprised so that the polishing head body 21 is connected with the annular guide ring 29 for holding the edge of the work W during polishing process and with the second height adjustment mechanism 27, and thereby a position in height direction of the guide ring 29 can be vertically changed. The position of the guide ring 29 can be adjusted in such a manner that a space between the polishing pad and the guide ring is within a range of 25-45% of a thickness of the work W.

In this manner, when the mechanism (the first height adjustment mechanism) in which the mid plate is separated from the polishing head body to be capable of adjusting the height of the mid plate is provided, the height of the rubber film fixed to the mid plate can be adjusted. Due to this, pressure to the outer peripheral portion of the work can be changed by using the influence of stiffness of the side face of the rubber film. Further, it become easier that a processing condition is changed according to the work shape before polishing (rise or sag shape) to make the work after processing more uniform.

Moreover, when the mechanism (the second height adjustment mechanism) for adjusting the height of the polishing head body, namely the guide ring is provided, the space between the polishing pad and the guide ring can be kept constant and thereby it can be easier that the work is more stably held to perform the polishing of the work without a decrease in polishing rate and a deterioration of quality of the work surface.

Furthermore, when the space between the polishing pad and the guide ring is maintained within a range of 25-45% of a thickness of the work, a decrease in polishing rate caused by a shortage in supply of the polishing agent occurred when the space between the polishing pad and the guide ring is too small can be prevented, and it can be prevented that the work cannot be held during the polishing process when the space is too big.

In addition, as described above, the ball screw can be used for the first height adjustment mechanism and the second height adjustment mechanism.

Use of the ball screw for the height adjustment mechanism enables easy and more precise adjustment and thereby more high precision and stable polishing can be performed.

Figure 3:
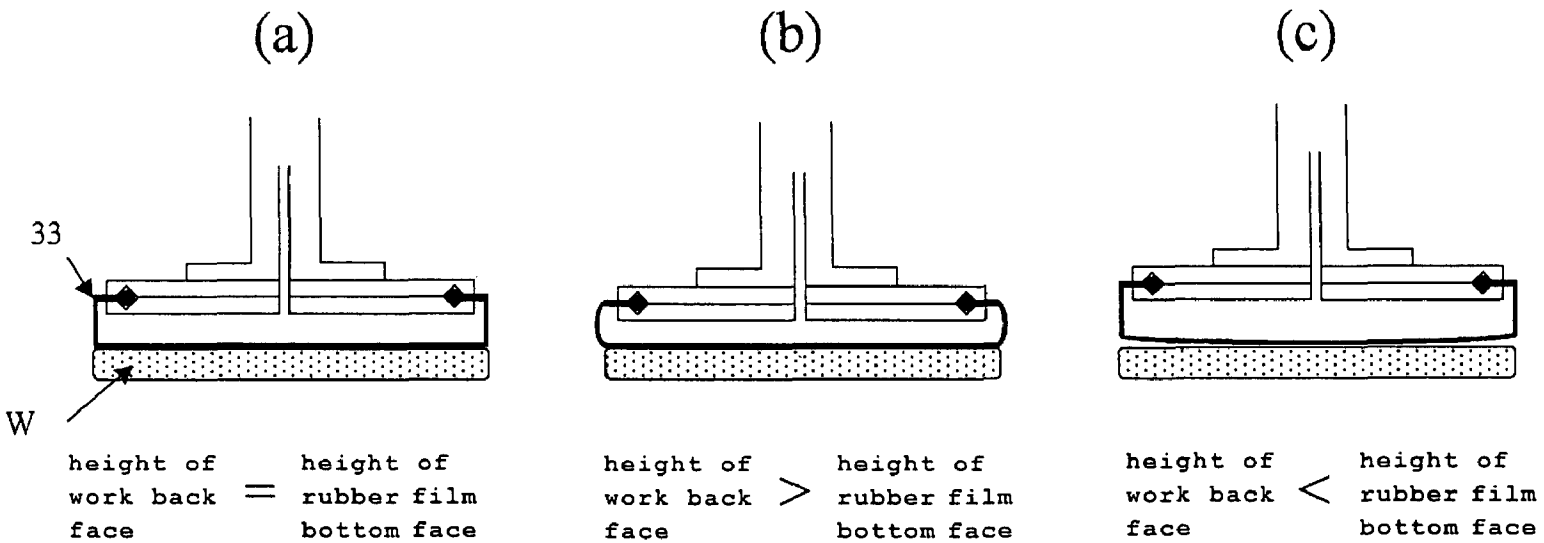
FIG. 3 are schematic views showing a positional relationship between the work and the rubber film in the polishing head according to the present invention.

FIG. 3 show a state of the work and the rubber film 33 when the position of the rubber film is changed. (a) shows a state in which the position of the bottom face of the rubber film 33 is the same as the position of the back face of the work W (basis position). (b) shows a state in which the position of the rubber film 33 is lowered than (a). (c) shows a state in which the position of the rubber film 33 is raised than (a). As shown in FIG. 3(*b*), when the position of the rubber film 33 is lowered, the bottom face of the rubber film 33 is strongly pressed to the back face of the work W and the side face of the rubber film 33 is inflated sideways. In this case, the pressure applied to the outer peripheral portion of the work W becomes high under the influence of stiffness of the rubber film and thereby the outer peripheral portion of the work can be formed in sag shape. Moreover, as shown in FIG. 3(*c*), when the position of the rubber film 33 is raised, since inflation of the center portion of the rubber film 33 becomes large and inflation of the outer peripheral portion of the rubber film 33 becomes small, the pressure applied to the outer peripheral portion of the work W becomes low and thereby the outer peripheral portion of the work can be formed in rise shape.

As described above, the shape of the outer peripheral portion of the work W can be controlled to be formed in any of flat, sag and rise shape by changing the position of the rubber film 33. Therefore, it becomes easier that the shape of the work W can be modified into flat shape by adjusting the position of the rubber film 33 according to the shape of the work W before polishing (flat, sag, rise).

Figure 4:
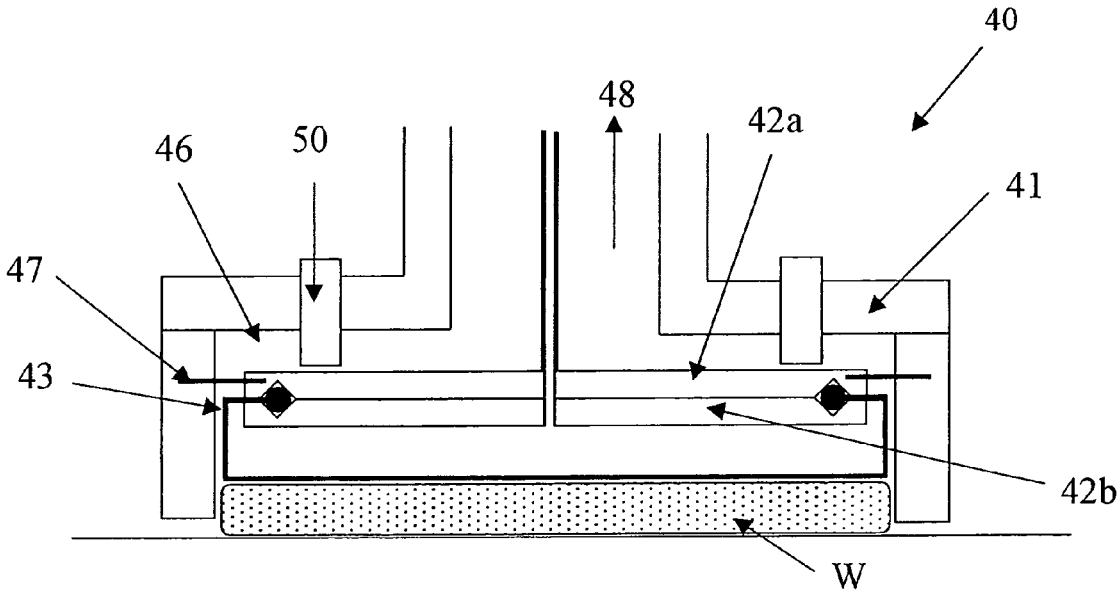
FIG. 4 is a schematic sectional view showing a third embodiment of the polishing head according to the present invention.

FIG. 4 shows a third embodiment of the polishing head according to the present invention. The polishing head 40 is an example of means in which a mechanical vertical moving mechanism as shown in FIG. 2 is not used as a means for adjusting the height of the rubber film 43. The mid plate 42*a* is connected with the polishing head body 41 through the elastic film 47. The second height adjustment mechanism 48 for adjusting pressure of the second sealed space portion 46 sealed by the mid plate 42*a*, elastic film 47 and the polishing head body 41 reduces the pressure so that the mid plate 42*a*, 42*b* and the rubber film 43 are raised. In addition, the stopper 50 attached to the polishing head body adjusts the height of the mid plate. Consequently, the position of the rubber film 43 is adjusted. This means enables adjusting the height of the rubber film by simpler structure.

In this manner, the mid plate can be raised and lowered by connecting the mid plate portion having the rubber film with the polishing head body through the elastic film and by adjusting the pressure of the second sealed space portion sealed with the mid plate portion, the elastic film and the polishing head body. Moreover, the position in a height direction of the mid plate can be adjusted by adjusting the height of the stopper attached to the polishing head body. As a result, the height of the rubber film can be controlled by a simple mechanism.

Further, a piezoelectric device is used as the stopper. When such a mechanism in which a thickness of the stopper is changed by applying voltage is incorporated, the height of the mid plate and the rubber film can be automatically adjusted to an optional position.

In addition, when the stopper is formed with a piezoelectric device to make a thickness of the stopper variable, the height of the rubber film can be automatically adjusted to an optional position. Therefore, the shape of the outer peripheral portion can be optionally and automatically adjusted from sag to rise according to the shape of the work before polishing, and thereby the work can be more flatly polished.

Figure 5:
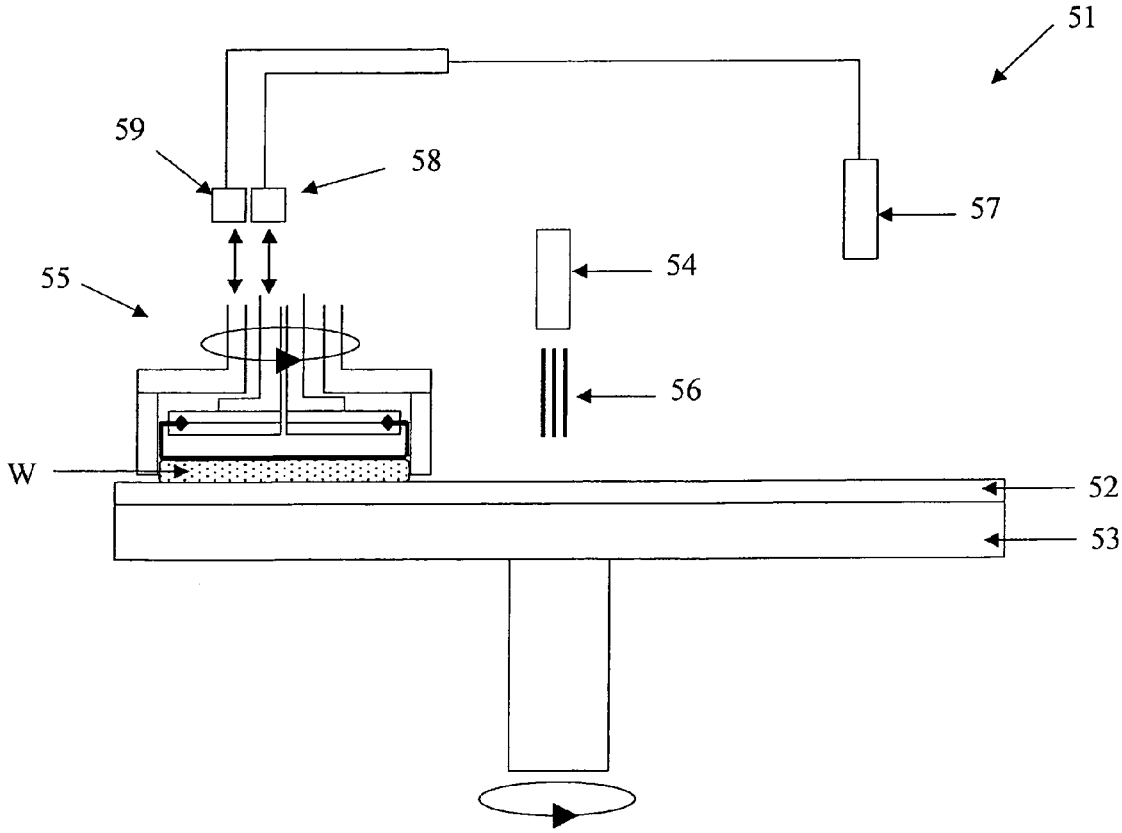
FIG. 5 is a schematic constitution view showing an example of a polishing apparatus comprising the polishing head according to the present invention.

FIG. 5 shows an example of a polishing apparatus according to the present invention. The polishing apparatus 51 comprises a turn table 53 in which the polishing pad 52 is attached, a polishing agent supply mechanism 54 for supplying a polishing agent 56, the polishing head 55 according to the present invention as shown in FIG. 2 and the like.

In this manner, when the work is polished using the polishing apparatus comprising the polishing head according to the present invention, the work can be polished with applying a uniform polishing load over the work to maintain a high flatness over the whole surface of the work, in particular in the outer peripheral portion.

Further, a length measurement sensor 57 for detecting a distance between the polishing head body and the polishing pad without contact using leaser and the like can be comprised above the polishing pad 52. The sensor 57 for a length measurement detects a distance to the polishing pad 52 (a thickness of the polishing pad) and a distance to the polishing head body 55. The result of the detection is sent to the first height adjustment mechanism 58 and the second height adjustment mechanism 59.

The position of the rubber film can be adjusted to an optimum position according to the thickness of the work W and the polishing pad 52 by the first height adjustment mechanism 58. Moreover, the position of the guide ring can be simultaneously adjusted to an optimum position by the vertical moving mechanism through the second height adjustment mechanism 59.

In this manner, when the first height adjustment mechanism that can adjust the height of the mid plate, namely the rubber film according to the distance between the polishing head body and the polishing pad detected by the sensor is provided, the work can be polished to modify the shape according to the shape of the work before polishing. As a result, the surface flatness of the work can be made better. Further, when the second height adjustment mechanism that adjusts the height of the polishing head body according to the distance between the polishing head body and the polishing pad detected by the sensor, the space between the polishing pad and the guide ring can be kept constant and thereby the work can be stably held to perform the polishing of the work without a decrease in polishing rate and a deterioration of quality of the work surface.

Hereinafter, the present invention is explained in detail according to Examples and Comparative Examples. However, the present invention is not limited to these.

EXAMPLE

As shown in FIG. 2, two mid plates having a thickness of 3 mm and an outer diameter of 293 mm were connected with bolts to hold by pinching the boot shaped rubber film having a thickness of 1 mm, a height of 6.5 mm and an outer diameter of the bottom face of 301 mm in which the end portion is formed in O-ring shape (a diameter of 2 mm), a diameter of the end portion is 289 mm. The guide ring having an inner diameter of 302 mm was arranged in a periphery of the rubber film. The mechanism using a ball screw was used as a vertical moving mechanism of the rubber film and of the guide ring.

Silicon single crystal wafers having a diameter of 300 mm and a thickness of 775 μm as the work were polished using the polishing apparatus comprising the polishing head described above as follows. It is to be noted that the used silicon single crystal wafer was given primary polishing on its both faces in advance and its edge portion was also polished. Also, the turn table having a diameter of 800 mm was used, and a usual one was used as the polishing pad.

At the polishing, an alkali solution containing coroidal silica was used as the polishing agent, and the polishing head and the turn table were rotated at 31 rpm and 29 rpm, respectively. A polishing load (pressing force) of the work was set as pressure of the first pressure adjustment mechanism was 20 kPa. The polishing time was 80 seconds. The space between guide ring and polishing pad was adjusted to 250 μm. The height of the rubber film was set at five conditions of −0.25 mm, −0.15 mm, 0 mm, +0.05 mm, +0.10 mm when the height of the back face of the work was 0 mm as a basis position and a direction in which the rubber film was separated away from the work was minus. The polishing process of the surface of the work was performed respectively.

The polishing stock removal dispersion in a plane of the work polished as above was evaluated. The polishing stock removal is obtained by measuring the thickness of the work before and after the polishing in a region excluding 2 mm width in the outermost circumference portion as a flatness guarantee area in a plane with a flatness measurement instrument and by taking a difference in the thickness of the work.

Figure 6:
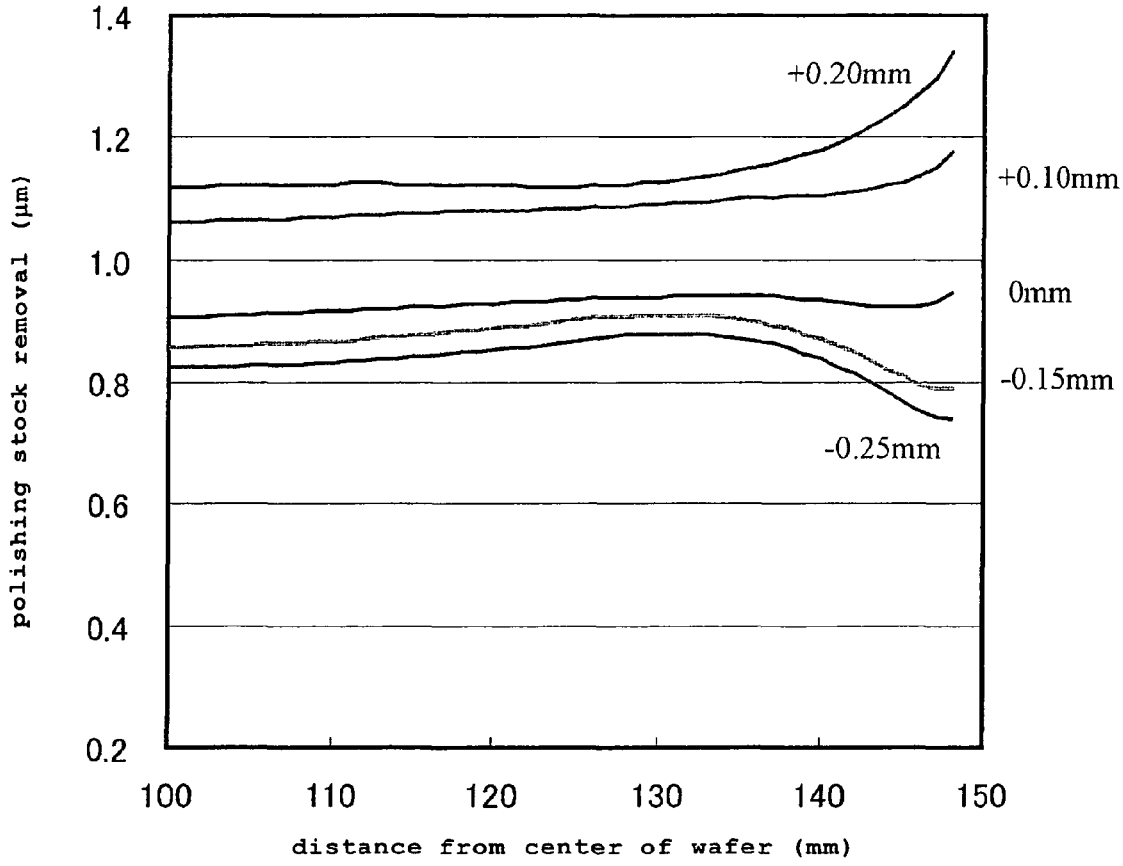
FIG. 6 is a chart showing polishing stock removal distribution of the work polished in Example.

As a result, the polishing stock removal distribution of the work is shown in FIG. 6 in which the distance from its center is 100 mm to 148 mm. FIG. 6 is a chart showing polishing stock removal distribution of the work polished in Example.

In the condition of the basis height of 0 mm, the work was flatly polished to the outer peripheral portion. The result was good.

Moreover, it was confirmed that the polishing stock removal of the outer portion than about 140 mm from the center of the work changed due to change of the position of the rubber film. For example, in the case of +0.20 mm, that is, pressing the work, the outer peripheral portion of the work can be formed in sag shape. In the case of −0.25 mm, that is, making inflation of the outer peripheral portion of the rubber film small, the outer peripheral portion of the work can be formed in rise shape.

Comparative Example 1

Figure 9:
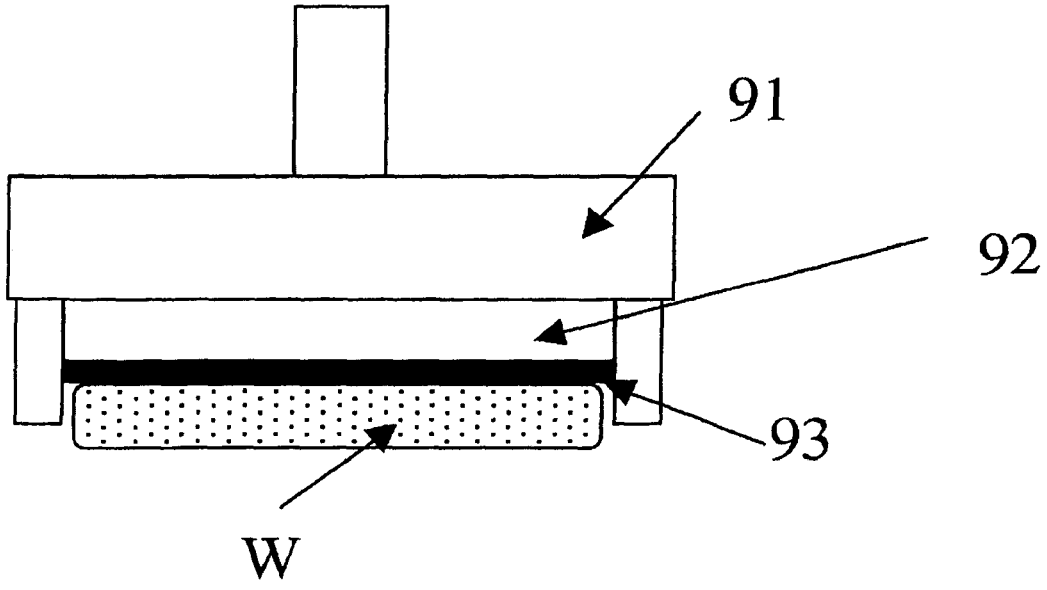
FIG. 9 PRIOR ART
FIG. 9 is a schematic sectional view showing an example of a conventional polishing head.
Figure 10A:
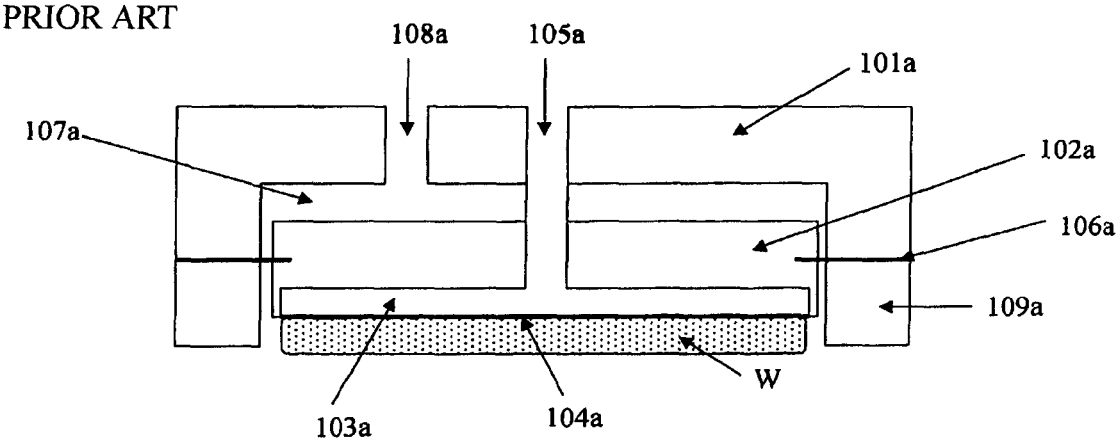
FIG. 10a PRIOR ART
FIG. 10*a* is a schematic sectional view showing an example of a conventional polishing head.
Figure 10B:
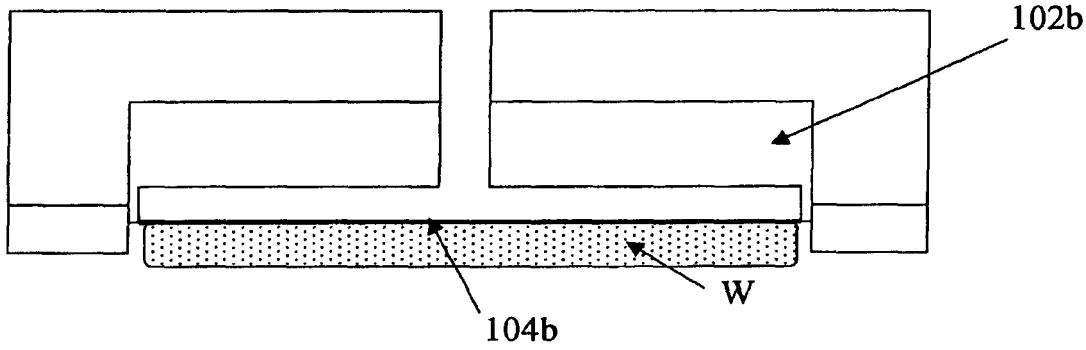
FIG. 10b PRIOR ART
FIG. 10*b* is a schematic sectional view showing another example of a conventional polishing head.
Figure 10C:
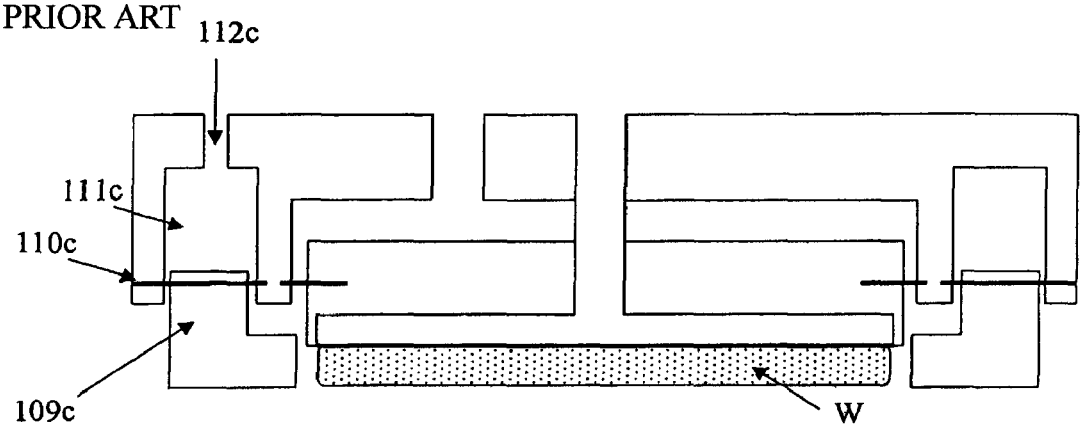
FIG. 10c PRIOR ART
FIG. 10*c* is a schematic sectional view showing another example of a conventional polishing head.
Figure 10D:
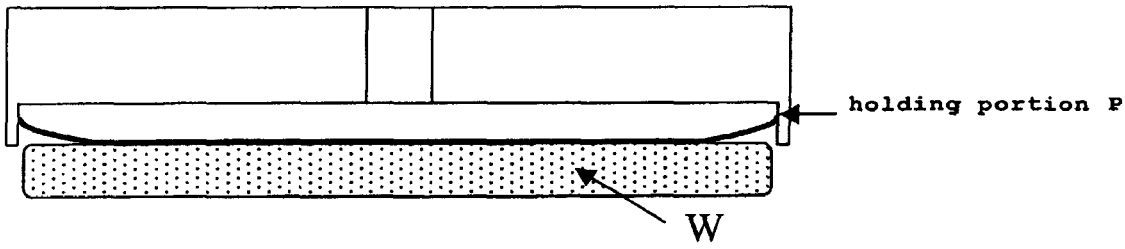
FIG. 10d PRIOR ART
FIG. 10*d* is a schematic sectional view showing another example of a conventional polishing head.

The polishing process of the surface of the work W was performed using the polishing apparatus comprising the polishing head in which the work was held on a work holding plate provided with the guide ring in a periphery as shown in FIG. 9, as with example. However, a load was directly applied to the holding plate so that a unit load of 20 kPa is applied to the work W.

Comparative Example 2-1

The polishing process of the surface of the work was performed using the polishing apparatus comprising the polishing head in which the holding end portion of the rubber film is near the work holding portion as shown in FIG. 10(*b*).

Comparative Example 2-2

The polishing process of the surface of the work was performed using the polishing apparatus comprising the polishing head as shown in FIG. 10(*d*). Amount of raising in position of the holding point P of the rubber film against Comparative Example 2-1 was 0.2 mm.

Figure 7:
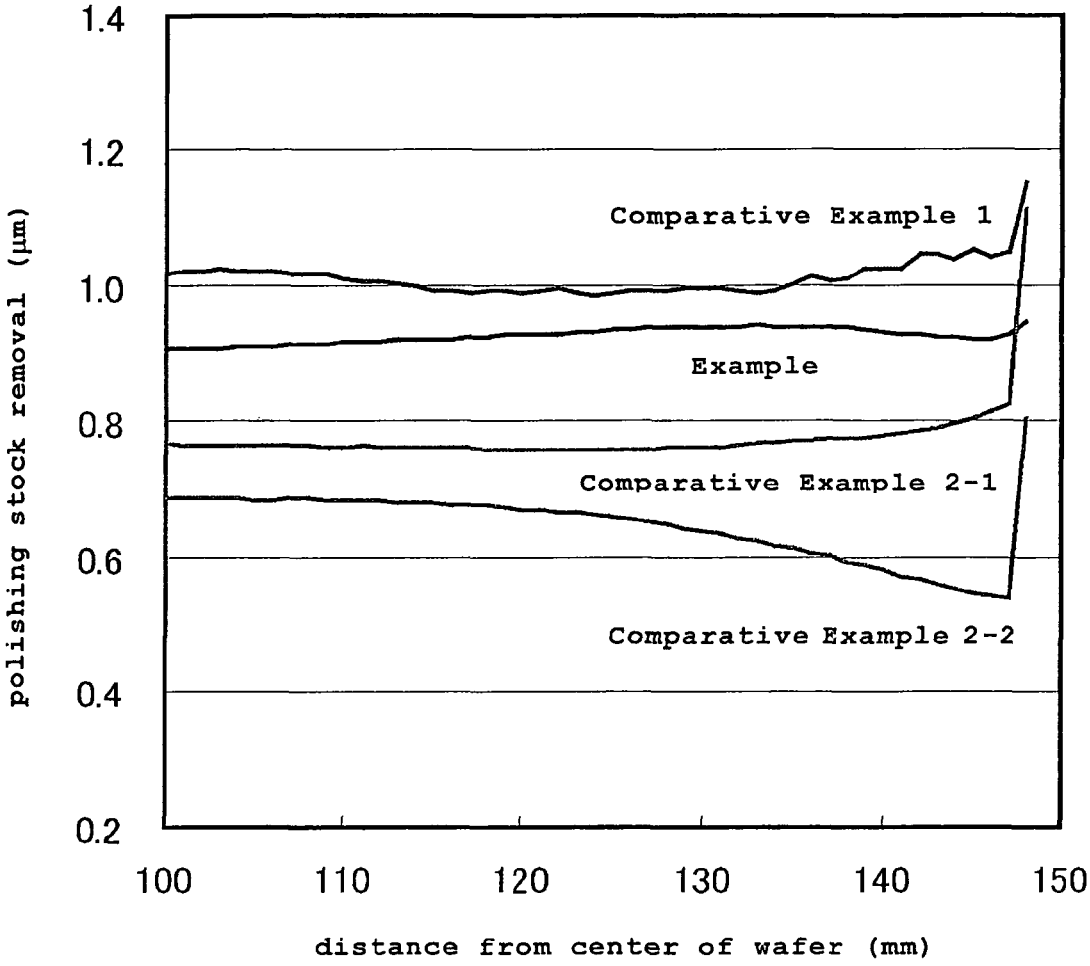
FIG. 7 is a chart showing polishing stock removal distribution of the work polished in Example, Comparative Example 1, Comparative Example 2-1 and Comparative Example 2-2.
Figure 8:
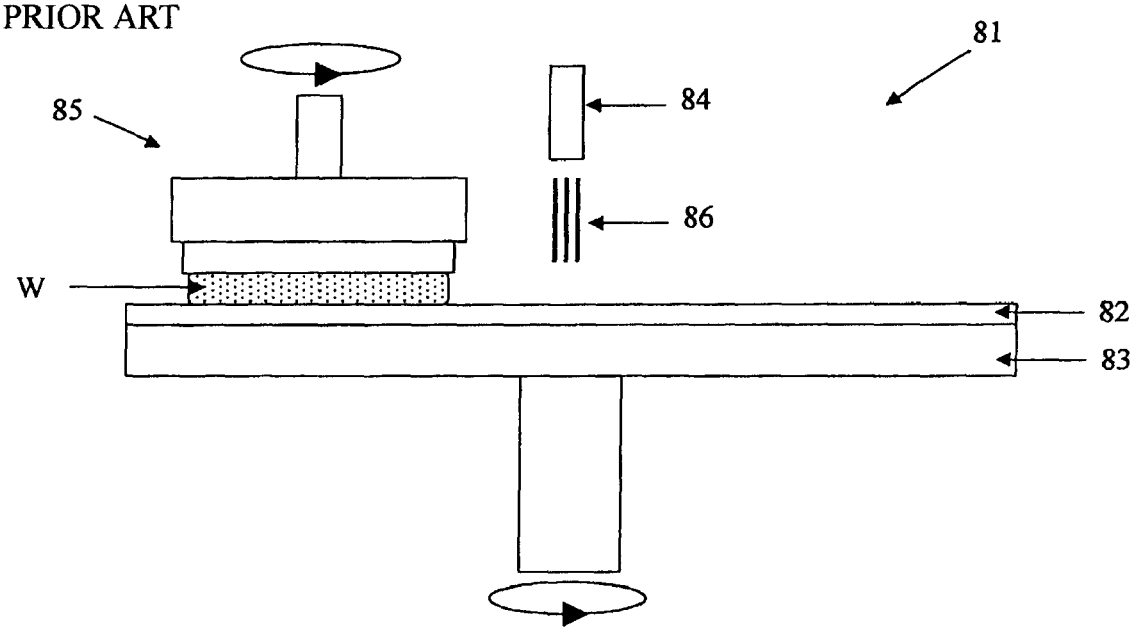
FIG. 8 PRIOR ART
FIG. 8 is a schematic constitution view showing an example of a single-side polishing apparatus.

The polishing stock removal distribution is shown in FIG. 7 in which the distance from the center of the work was 100 mm to 148 mm in Comparative Example 1, Comparative Example 2-1 and Comparative Example 2-2. Moreover, in order to compare, the polishing stock removal distribution in Example of performing the polishing process in the rubber film basis height of 0 mm state is also shown in FIG. 7.

As explained above, the work polished by using the polishing head of Example was flatly polished to the outer peripheral portion. The result was good.

On the other hand, in the case of Comparative Example 1, the polishing stock removal finely dispersed in a plane of the work and further the polishing stock removal of the outer periphery portion became large.

In addition, in the case of Comparative Example 2-1, the rubber film was held at the opening end portion of the concave portion of the mid plate and substantial stiffness of the rubber film in that neighborhood became high, pressure applied on the outer peripheral portion of the work becomes high and the polishing stock removal of the outer periphery portion became extremely large.

Moreover, in the case of Comparative Example 2-2, sag of the outermost peripheral portion was somewhat improved by raising the holding point position of the rubber film by 0.2 mm against Comparative Example 2-1. Conversely, the portion from about 120 mm became rise shape and it resulted in degradation of the polishing stock removal uniformity.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

For example, the polishing head according to the present invention is not restricted to the embodiments shown in FIGS. 1, 2, 3. The shape and the like of the polishing head body can be designed except requirements described in claims of the present invention as appropriately, for example.

Furthermore, the feature of the polishing apparatus is not also restricted to one shown in FIG. 5. The polishing apparatus can comprise a plurality of the polishing heads according to the present invention.

The invention claimed is:

1. A polishing head having at least:

an approximately discoid mid plate;

a rubber film held by the mid plate, the rubber film covering at least a lower face portion and a side face portion of the mid plate; and an annular guide ring at a lower portion of a polishing head body, the annular guide ring being around a periphery of the rubber film;

the polishing head in which there exists a first sealed space portion surrounded by the mid plate and the rubber film, a pressure of the first sealed space portion can be changed by a first pressure adjustment mechanism, a back face of a work is held on a lower face portion of the rubber film, and a surface of the work is brought into sliding contact with a polishing pad attached onto a turn table for performing polishing, wherein an end portion of the rubber film held by the mid plate is formed in O-ring shape, the mid plate is formed to be capable of vertically splitting in two pieces, the mid plate and the rubber film have a space at least throughout a whole surface of the lower face portion and the side face portion of the mid plate, and the rubber film is held by pinching the O-ring end portion of the rubber film between the split mid plate.

2. The polishing head according to claim 1, wherein the mid plate is separated from the polishing head body; the polishing head comprises a first height adjustment mechanism for adjusting a position in a height direction of the mid plate with being independent from the polishing head body.

3. The polishing head according to claim 1, wherein the polishing head body is separated from the mid plate; the polishing head comprises a second height adjustment mechanism for adjusting a position in a height direction of the polishing head body with being independent from the mid plate; the second height adjustment mechanism maintains a distance of a space between the polishing pad and the guide ring within a range of 25-45% of a thickness of the work.

4. The polishing head according to claim 2, wherein the polishing head body is separated from the mid plate; the polishing head comprises a second height adjustment mechanism for adjusting a position in a height direction of the polishing head body with being independent from the mid plate; the second height adjustment mechanism maintains a distance of a space between the polishing pad and the guide ring within a range of 25-45% of a thickness of the work.

5. The polishing head according to claim 2, wherein the first height adjustment mechanism uses a ball screw.

6. The polishing head according to claim 3, wherein the second height adjustment mechanism uses a ball screw.

7. The polishing head according to claim 4, wherein the first height adjustment mechanism and the second height adjustment mechanism use a ball screw.

8. The polishing head according to claim 2 comprises: an elastic film for connecting the mid plate with the polishing head body; and a stopper attached to the polishing head body, wherein there exists a second sealed space portion surrounded by the mid plate, the polishing head body and the elastic film; a pressure of the second sealed space portion can be changed by a second pressure adjustment mechanism; and the first height adjustment mechanism is the stopper.

9. The polishing head according to claim 8, wherein the stopper is a piezoelectric device.

10. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 1.

11. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 2.

12. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 3.

13. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 4.

14. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 5.

15. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 6.

16. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 7.

17. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 8.

18. A polishing apparatus used for polishing a surface of a work at least comprising: a polishing pad attached onto a turn table; a polishing agent supply mechanism for providing a polishing agent to the polishing pad; and a polishing head for holding the work, which is the polishing head according to claim 9.

19. The polishing apparatus according to claim 13 comprises: a sensor for detecting a distance between the polishing head body and the polishing pad without contact;

the first height adjustment mechanism; and the second height adjustment mechanism, wherein the first height adjustment mechanism adjusts a position in a height direction of the mid plate and the rubber film according to the distance between the polishing head body and the polishing pad detected by the sensor; and the second height adjustment mechanism adjusts a position in a height direction of the space between the polishing pad and the guide ring according to the distance between the polishing head body and the polishing pad detected by the sensor.

20. The polishing apparatus according to claim 18 comprises: a sensor for detecting a distance between the polishing head body and the polishing pad without contact; the first height adjustment mechanism; and the second height adjustment mechanism, wherein the first height adjustment mechanism adjusts a position in a height direction of the mid plate and the rubber film according to the distance between the polishing head body and the polishing pad detected by the sensor; and the second height adjustment mechanism adjusts a position in a height direction of the space between the polishing pad and the guide ring according to the distance between the polishing head body and the polishing pad detected by the sensor.

* * * * *